US010130838B2

(12) United States Patent
Murrell

(10) Patent No.: US 10,130,838 B2
(45) Date of Patent: Nov. 20, 2018

(54) ABDOMINAL EXERCISE ASSEMBLY

(71) Applicant: Robert Murrell, Deer Park, TX (US)

(72) Inventor: Robert Murrell, Deer Park, TX (US)

( * ) Notice: Subject to any disclaimer, the term of this patent is extended or adjusted under 35 U.S.C. 154(b) by 195 days.

(21) Appl. No.: 15/364,963

(22) Filed: Nov. 30, 2016

(65) Prior Publication Data

US 2018/0147444 A1 May 31, 2018

(51) Int. Cl.
*A63B 22/00* (2006.01)
*A63B 23/02* (2006.01)
*A63B 21/16* (2006.01)

(52) U.S. Cl.
CPC ..... *A63B 23/0211* (2013.01); *A63B 21/1672* (2015.10); *A63B 2209/00* (2013.01)

(58) Field of Classification Search
None
See application file for complete search history.

(56) References Cited

U.S. PATENT DOCUMENTS 3,134,592 A 5/1964 Sharkey
3,826,490 A * 7/1974 Mossman ..... A63B 21/154 482/133
4,378,939 A 4/1983 Wild
4,515,361 A * 5/1985 Melillo ..... A63B 23/0211 482/140
4,550,907 A * 11/1985 Melillo ..... A63B 23/0211 482/140
4,601,464 A * 7/1986 Mousel ..... A63B 22/0694 482/60
4,679,788 A * 7/1987 Adler ..... A63B 21/0615 482/108
4,925,184 A * 5/1990 McJunkin, Jr. .... A63B 22/0605 482/60
5,009,417 A * 4/1991 Sarkozi ..... A63B 23/0211 482/140
5,108,092 A * 4/1992 Hurst ..... A63B 22/0005 482/60
5,160,306 A 11/1992 Lui
5,207,628 A * 5/1993 Graham ..... A63B 23/0211 482/140
D506,514 S 6/2005 Bernstein
7,172,540 B2 2/2007 Nguyen
7,670,271 B2 * 3/2010 Finch ..... A63B 21/00047 482/140
7,883,453 B1 2/2011 Cooper
9,669,255 B2 * 6/2017 Henniger ..... A63B 21/4039
(Continued)

*Primary Examiner* — Stephen R Crow

(57) ABSTRACT

An abdominal exercise assembly for exercising abdominal muscles includes a plate that is rigid. The plate has a first end that is configured to insert between a mattress and a box spring of a bed. A second end of the plate is positioned proximate to an edge of the bed. A support is slidably coupled to the second end. The support is configured to position proximate to and parallel to the edge of the bed. A bar, coupled to the support distal from the plate, extends bidirectionally from the support in parallel with the second end of the plate. The bar is configured to be selectively vertically positioned relative to the plate. The plate is retained in a substantially horizontal configuration by a combination of the weight of the mattress and a user positioned on the mattress. The bar is configured to selectively position legs of a user.

19 Claims, 4 Drawing Sheets

(56) References Cited

U.S. PATENT DOCUMENTS

| | | | | |
|---|---|---|---|---|
| 2005/0266971 | A1* | 12/2005 | Nguyen | A63B 23/0211 482/140 |
| 2012/0270709 | A1* | 10/2012 | Howard | A63B 23/0211 482/140 |
| 2014/0066273 | A1 | 3/2014 | Jimoh | |

* cited by examiner

ABDOMINAL EXERCISE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to exercise assemblies and more particularly pertains to a new exercise assembly for exercising abdominal muscles.

BRIEF SUMMARY OF THE INVENTION

An embodiment of the disclosure meets the needs presented above by generally comprising a plate that is rigid. The plate has a first end that is configured to insert between a mattress and a box spring of a bed. A second end of the plate is positioned proximate to an edge of the bed. A support is slidably coupled to the second end. The support is configured to position proximate to and parallel to the edge of the bed. A bar, coupled to the support distal from the plate, extends bidirectionally from the support in parallel with the second end of the plate. The bar is configured to be selectively vertically positioned relative to the plate. The plate is retained in a substantially horizontal configuration by a combination of the weight of the mattress and a user positioned on the mattress. The bar is configured to selectively position legs of a user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
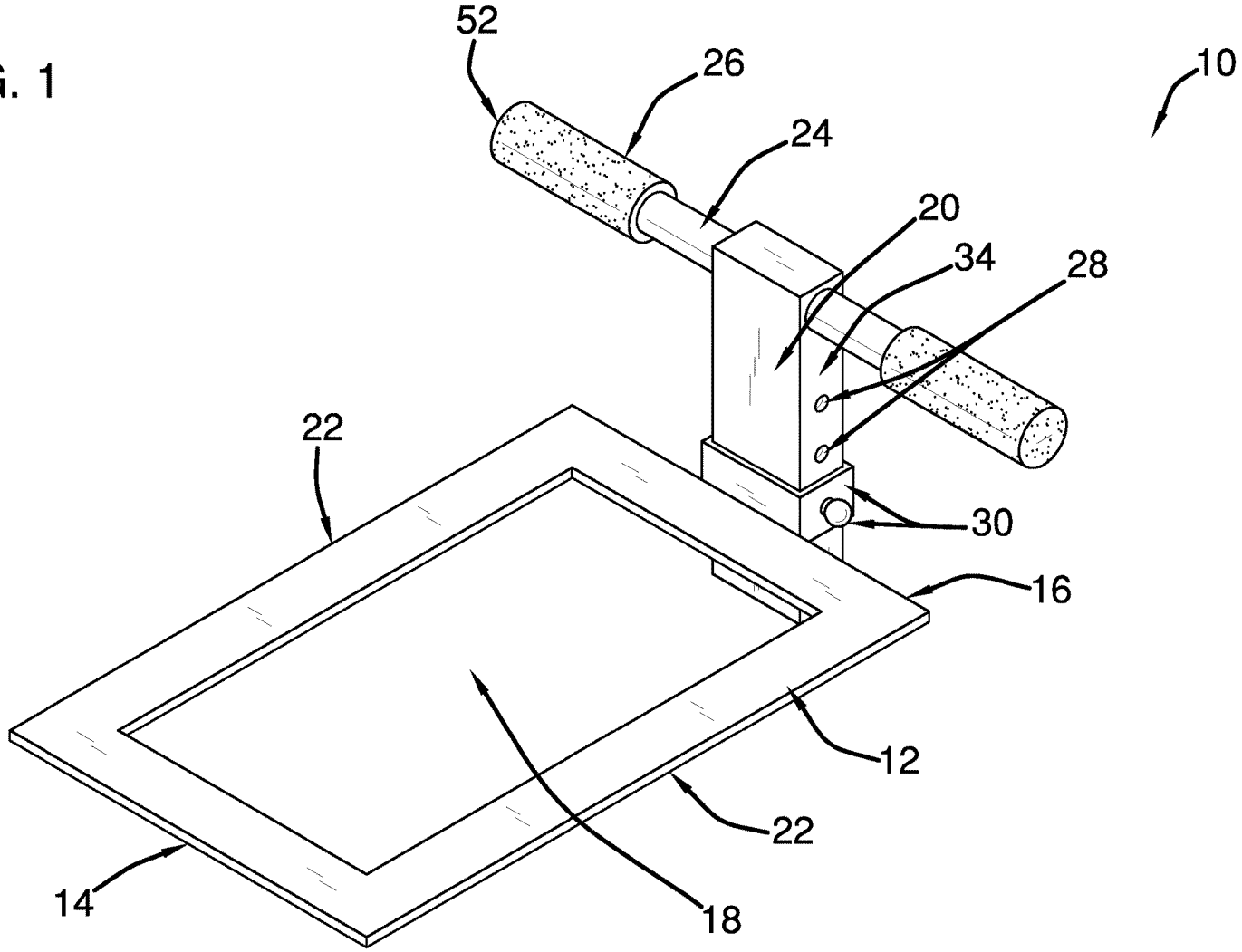
FIG. 1 is an isometric perspective view of an abdominal exercise assembly according to an embodiment of the disclosure.
Figure 2:
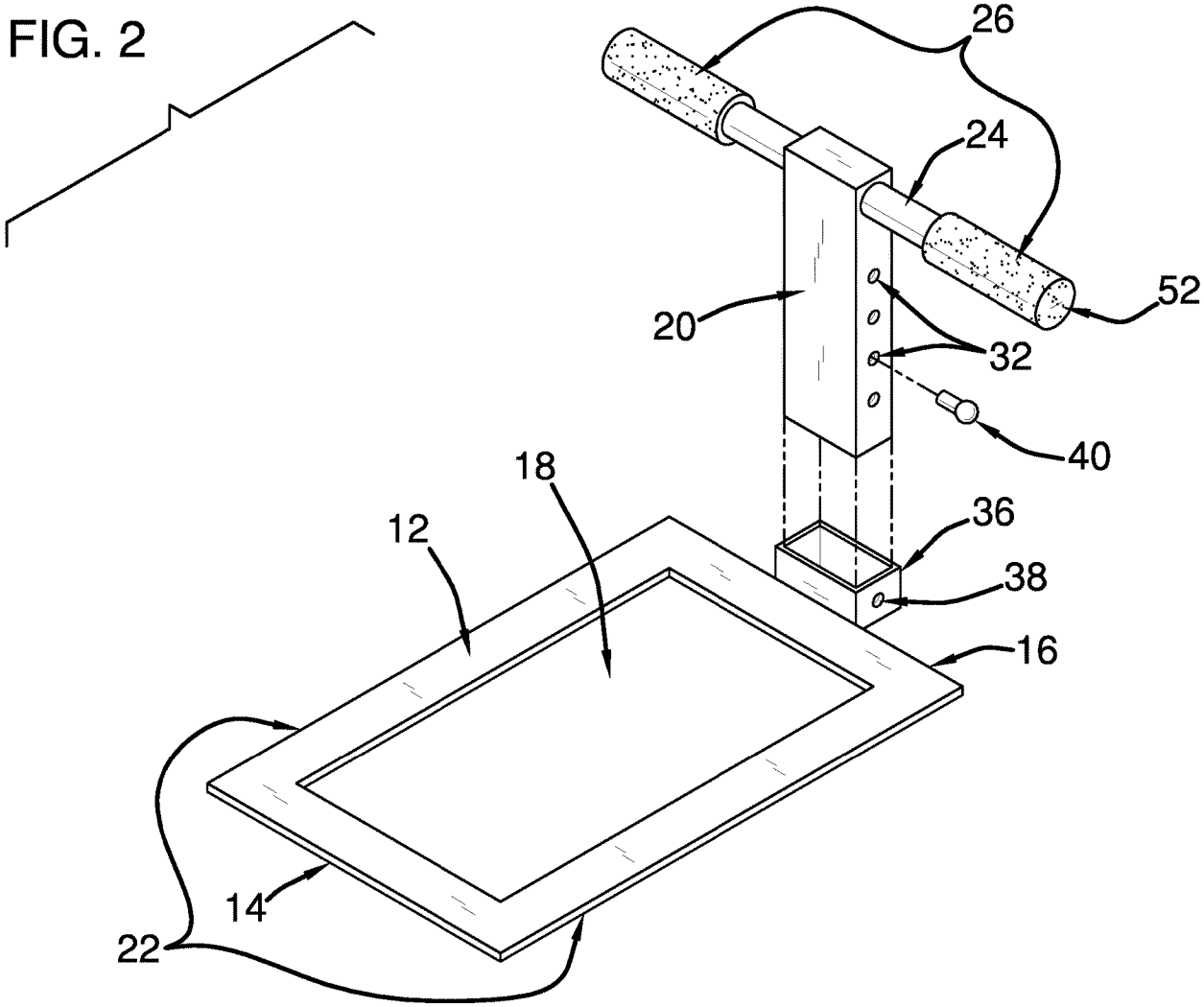
FIG. 2 is an exploded view of an embodiment of the disclosure.
Figure 3:
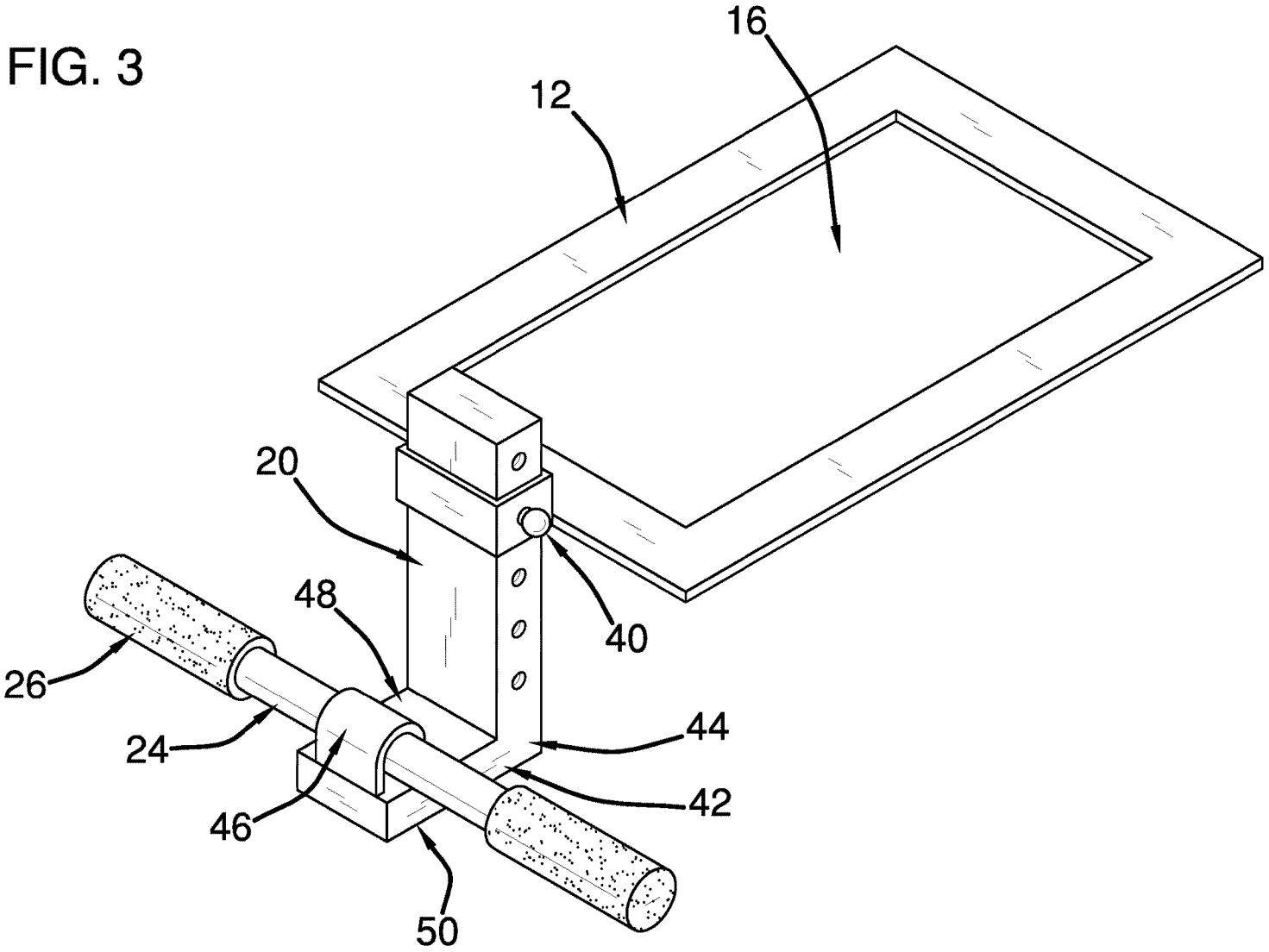
FIG. 3 is an isometric perspective view of an embodiment of the disclosure.
Figure 4:
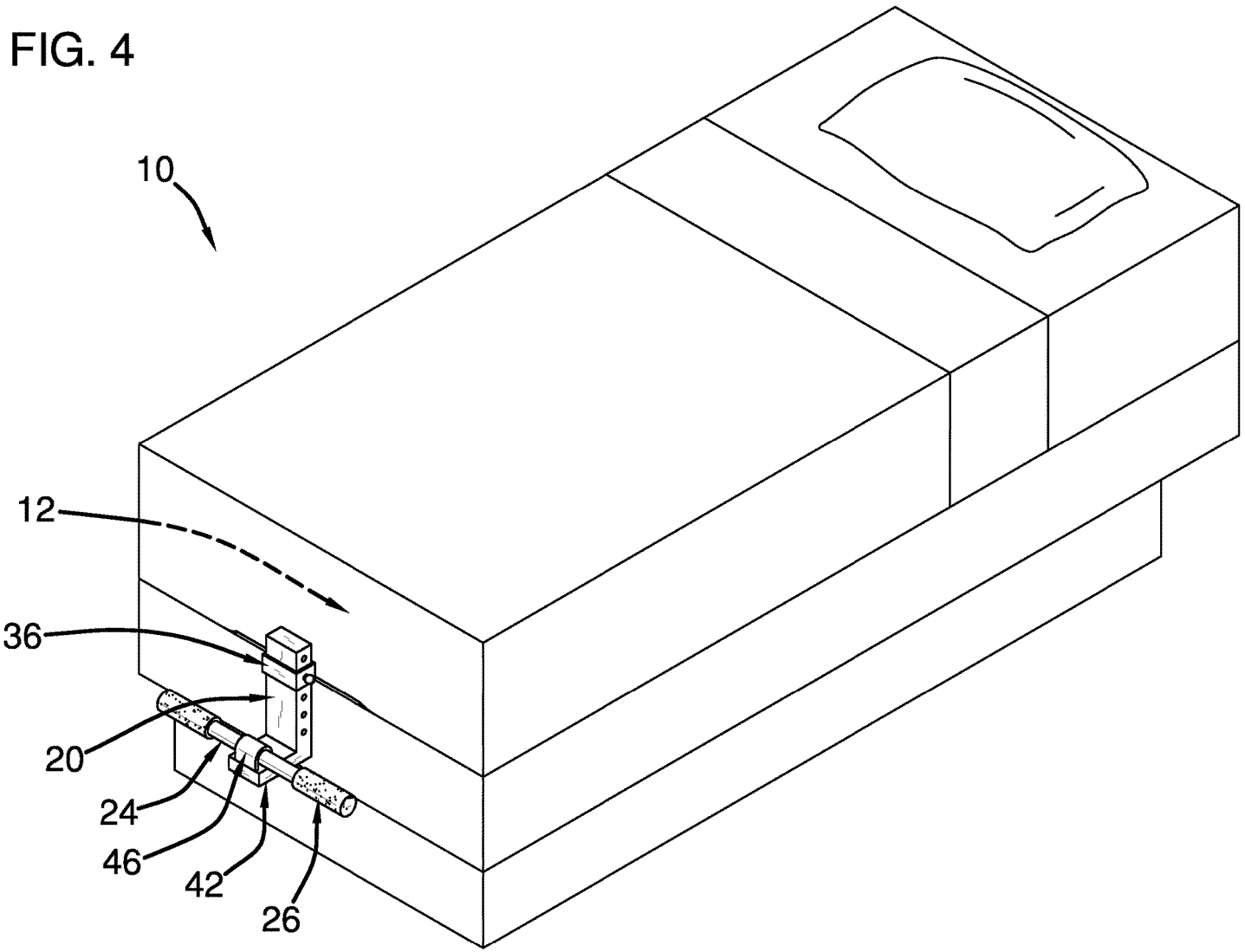
FIG. 4 is an in-use view of an embodiment of the disclosure.

With reference now to the drawings, and in particular to FIGS. 1 through 4 thereof, a new exercise assembly embodying the principles and concepts of an embodiment of the disclosure and generally designated by the reference numeral 10 will be described.

As best illustrated in FIGS. 1 through 4, the abdominal exercise assembly 10 generally comprises a plate 12 that is rigid. The plate 12 has a first end 14 that is configured to insert between a mattress and a box spring of a bed. A second end 16 of the plate 12 is positioned proximate to an edge of the bed. In one embodiment, the plate 12 is substantially rectangularly shaped. In another embodiment, the plate 12 is substantially squarely shaped. In yet another embodiment, the plate 12 comprises metal. In still yet another embodiment, the plate 12 comprises aluminum.

In one embodiment, a cutout 18 is positioned in the plate 12. In another embodiment, the cutout 18 is shaped complementarily to the plate 12.

A support 20 is slidably coupled to the second end 16 of the plate 12. The support 20 is configured to position proximate to and parallel to the edge of the bed. The support 20 extends perpendicularly from the plate 12 equally distant from opposing sides 22 of the plate 12. In one embodiment, the support 20 is substantially rectangularly box shaped.

A bar 24 is coupled to the support 20 distal from the plate 12. The bar 24 extends bidirectionally from the support 20 in parallel with the second end 16 of the plate 12. The bar 24 is configured to selectively vertically position relative to the plate 12. The bar 24 is configured to selectively position legs of a user. In one embodiment, the bar 24 is circularly shaped when viewed longitudinally. In another embodiment, the bar 24 is rotatably coupled to the support 20 so that the bar 24 is longitudinally axially rotatable.

Each of a pair of pads 26 is coupled to the bar 24 adjacent to a respective opposing end 52 of the bar 24. The pads 26 are configured to position between the bar 24 and the legs of the user.

A first coupler 28 is coupled to the support 20. A second coupler 30 is coupled to the plate 12. The second coupler 30 is complementary to the first coupler 28. The second coupler 30 is positioned to selectively couple to the first coupler 28 to couple the support 20 to the plate 12. The bar 24 is selectively vertically positionable relative to the plate 12.

In one embodiment, the first coupler 28 comprises a plurality of holes 32 that is positioned in a side 34 of the support 20. The plurality of holes 32 is arrayed longitudinally along the side 34 of the support 20. The second coupler 30 comprises a bracket 36 that is coupled to and extends from the plate 12. The bracket 36 is complementary to the support 20. The support 20 is slidably positionable within the bracket 36. A penetration 38 is positioned through the bracket 36. The penetration 38 is selectively alignable with each of the plurality of holes 32. The penetration 38 is complementary to each of the plurality of holes 32. The second coupler 30 also comprises a pin 40 that is complementary to the penetration 38 and each of the plurality of holes 32. The pin 40 is positioned to insert through the penetration 38 and a respective hole 32 to couple the support 20 to the bracket 36. The support 20 is coupled to the plate 12 and the bar 24 is selectively vertically positionable relative to the plate 12.

In one embodiment, a spacer 42 is coupled to and extends perpendicularly from an endpoint 44 of the support 20. The bar 24 is coupled to the spacer 42 distal from the support 20. The spacer 42 is positioned to offset the bar 24 relative to the edge of the bed. The legs of the user are positionable between the bar 24 and the edge of the bed.

A fastener 46 is coupled to the spacer 42 distal from the support 20. The fastener 46 is complementary to the bar 24. The fastener 46 is positioned to couple to the bar 24 to couple the bar 24 to the spacer 42. In one embodiment, the fastener 46 is positioned on an inside face 48 of the spacer 42. In another embodiment, the fastener 46 is positioned on an outside face 50 of the spacer 42.

In use, the plate 12 is configured to position between the mattress and the box spring of the bed. The plate 12 is configured to be retained in the substantially horizontal configuration by the combination of the weight of the mattress and of the user who is positioned on the mattress above the plate 12. The pin 40 is positioned to insert through the penetration 38 and the respective hole 32 to couple the support 20 to the bracket 36 and thus to the plate 12. The bar 24 is selectively vertically positionable relative to the plate 12. The bar 24 is configured to selectively position the legs of a user. The pads 26 are configured to position between the bar 24 and the legs of the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An abdominal exercise assembly comprising: a plate, said plate being rigid, said plate having a first end configured for insertion between a mattress and a box spring of a bed such that a second end of said plate is positioned proximate to an edge of the bed;

a support slidably coupled to said second end of said plate, wherein said support is positioned on said plate such that said support is configured for positioning proximate to and parallel to the edge of the bed;

a linear bar coupled to said support distal from said plate, said bar extending bidirectionally from said support in parallel with said second end of said plate; and said support being substantially rectangularly box shaped and open ended;

wherein said plate is configured for positioning between the mattress and the boxspring of the bed such that said plate is configured for retention in a substantially horizontal configuration by a combination of the weight of the mattress and of a user positioned on the mattress above said plate, wherein said support is positioned on said plate such that said bar is configured for selectively vertically positioning relative to said plate such that said bar is configured for selectively positioning legs of a user.

2. The assembly of claim 1, further including said plate being substantially rectangularly shaped.

3. The assembly of claim 2, further including said plate being substantially squarely shaped.

4. The assembly of claim 1, further including said plate comprising metal.

5. The assembly of claim 4, further including said plate comprising aluminum.

6. The assembly of claim 1, further including a cutout positioned in said plate.

7. The assembly of claim 6, further including said cutout being complementarily shaped to said plate.

8. The assembly of claim 1, further including said support extending perpendicularly from said plate equally distant from opposing sides of said plate.

9. The assembly of claim 1, further including said bar being circularly shaped when viewed longitudinally.

10. The assembly of claim 1, further including said bar being rotatably coupled to said support such that said bar is longitudinally axially rotatable.

11. The assembly of claim 1, further including a pair of pads, each said pad being coupled to said bar adjacent to a respective opposing end of said bar, wherein said pads are positioned on said bar such that said pads are configured for positioning between said bar and the legs of the user.

12. The assembly of claim 1, further comprising:

a first coupler coupled to said support;

a second coupler coupled to said plate, said second coupler being complementary to said first coupler; and wherein said second coupler is positioned on said plate such that said second coupler is positioned to selectively couple to said first coupler to couple said support to said plate such that said bar is selectively vertically positionable relative to said plate.

13. The assembly of claim 12, further comprising:

said first coupler comprising a plurality of holes positioned in a side of said support, said plurality of holes being arrayed longitudinally along said side of said support;

said second coupler comprising:

a bracket coupled to and extending from said plate, said bracket being complementary to said support such that said support is slidably positionable within said bracket, a penetration positioned through said bracket such that said penetration is selectively alignable with each of said plurality of holes, said penetration being complementary to each of said plurality of holes, and a pin complementary to said penetration and each of said plurality of holes; and wherein said pin is positioned for insertion through said penetration and a respective said hole to couple said support to said bracket such that said support is coupled to said plate and wherein said bar is selectively vertically positionable relative to said plate.

14. The assembly of claim 1, further including a spacer coupled to and extending perpendicularly from an endpoint of said support, said bar being coupled to said spacer distal from said support, wherein said spacer is positioned on said support such that said spacer is positioned to offset said bar relative to the edge of the bed, such that the legs of the user are positionable between said bar and the edge of the bed.

15. The assembly of claim 14, further including a fastener coupled to said spacer distal from said support, said fastener being complementary to said bar, wherein said fastener is positioned on said spacer such that said fastener is positioned to couple to said bar to couple said bar to said spacer.

16. The assembly of claim 15, further including said fastener being positioned on an inside face of said spacer.

17. The assembly of claim 1, further including said fastener being positioned on an outside face of said spacer.

18. An abdominal exercise assembly comprising:

a plate, said plate being rigid, said plate having a first end configured for insertion between a mattress and a box spring of a bed such that a second end of said plate is positioned proximate to an edge of the bed, said plate being substantially rectangularly shaped, said plate being substantially squarely shaped, said plate comprising metal, said plate comprising aluminum;

a cutout positioned in said plate, said cutout being complementarily shaped to said plate;

a support slidably coupled to said second end of said plate, wherein said support is positioned on said plate such that said support is configured for positioning proximate to and parallel to the edge of the bed, said support extending perpendicularly from said plate equally distant from opposing sides of said plate, said support being substantially rectangularly box shaped;

a bar coupled to said support distal from said plate, said bar extending bidirectionally from said support in parallel with said second end of said plate, wherein said support is positioned on said plate such that said bar is configured for selectively vertically positioning relative to said plate such that said bar is configured for selectively positioning legs of a user, said bar being circularly shaped when viewed longitudinally, said bar being rotatably coupled to said support such that said bar is longitudinally axially rotatable;

a pair of pads, each said pad being coupled to said bar adjacent to a respective opposing end of said bar, wherein said pads are positioned on said bar such that said pads are configured for positioning between said bar and the legs of the user;

a first coupler coupled to said support, said first coupler comprising a plurality of holes positioned in a side of said support, said plurality of holes being arrayed longitudinally along said side of said support;

a second coupler coupled to said plate, said second coupler being complementary to said first coupler, wherein said second coupler is positioned on said plate such that said second coupler is positioned to selectively couple to said first coupler to couple said support to said plate such that said bar is selectively vertically positionable relative to said plate, said second coupler comprising:

a bracket coupled to and extending from said plate, said bracket being complementary to said support such that said support is slidably positionable within said bracket, a penetration positioned through said bracket such that said penetration is selectively alignable with each of said plurality of holes, said penetration being complementary to each of said plurality of holes, a pin complementary to said penetration and each of said plurality of holes, and wherein said pin is positioned for insertion through said penetration and a respective said hole to couple said support to said bracket such that said support is coupled to said plate and wherein said bar is selectively vertically positionable relative to said plate;

a spacer coupled to and extending perpendicularly from an endpoint of said support, said bar being coupled to said spacer distal from said support, wherein said spacer is positioned on said support such that said spacer is positioned to offset said bar relative to the edge of the bed, such that the legs of the user are positionable between said bar and the edge of the bed;

a fastener coupled to said spacer distal from said support, said fastener being complementary to said bar, wherein said fastener is positioned on said spacer such that said fastener is positioned to couple to said bar to couple said bar to said spacer, said fastener being positioned on an inside face of said spacer; and wherein said plate is configured for positioning between the mattress and the box spring of the bed such that said plate is configured for retention in the substantially horizontal configuration by the combination of the weight of the mattress and of the user positioned on the mattress above said plate, wherein said pin is positioned for insertion through said penetration and said respective said hole to couple said support to said bracket such that said support is coupled to said plate and wherein said bar is selectively vertically positionable relative to said plate such that said bar is configured for selectively positioning the legs of a user, wherein said pads are positioned on said bar such that said pads are configured for positioning between said bar and the legs of the user.

19. The assembly of claim 18, further including said fastener being positioned on an outside face of said spacer.

* * * * *